US008376869B2

(12) United States Patent
Bloom et al.

(10) Patent No.: US 8,376,869 B2
(45) Date of Patent: Feb. 19, 2013

(54) AMUSEMENT RIDE SYSTEM AND METHOD

(75) Inventors: Philip Stephen Bloom, Pasadena, CA (US); Bing Yeh, Alhambra, CA (US)

(73) Assignee: Blammo, LLC, Alhambra, CA (US)

( * ) Notice: Subject to any disclaimer, the term of this patent is extended or adjusted under 35 U.S.C. 154(b) by 0 days.

(21) Appl. No.: 13/211,008

(22) Filed: Aug. 16, 2011

(65) Prior Publication Data

US 2011/0300958 A1 Dec. 8, 2011

Related U.S. Application Data

(63) Continuation of application No. 12/612,234, filed on Nov. 4, 2009, now Pat. No. 8,021,236.

(60) Provisional application No. 61/164,663, filed on Mar. 30, 2009.

(51) Int. Cl.
*A63G 1/34* (2006.01)
*A63G 1/00* (2006.01)

(52) U.S. Cl. ..... 472/43; 124/41.1; 273/317

(58) Field of Classification Search ..... 472/43, 472/13, 117, 128; 463/2, 5, 7; 273/317, 273/459; 124/1, 41.1, 79
See application file for complete search history.

(56) References Cited

U.S. PATENT DOCUMENTS 7,749,089 B1 * 7/2010 Briggs et al. ..... 472/136
7,955,168 B2 * 6/2011 Mendelsohn et al. ..... 463/2

* cited by examiner

*Primary Examiner* — Kien Nguyen
(74) *Attorney, Agent, or Firm* — Larry E. Severin

(57) ABSTRACT

An amusement ride system includes: a shooting device adapted to shoot a projectile; an aiming facility operable by a user to aim the shooting device; and a triggering device operable by the user to fire the shooting device. The user rides the vehicle, aims the shooting device, and fires the device to shoot the projectile. A method for a ride includes: providing a shooting device; providing a plurality of projectiles; and aiming and shooting the projectiles utilizing the shooting device.

7 Claims, 2 Drawing Sheets

AMUSEMENT RIDE SYSTEM AND METHOD

FILING DATE

This application claims the benefit of the filing date of U.S. Patent Application No. 61/164,663, filed Mar. 30, 2009.

BACKGROUND OF THE INVENTION

The present invention generally relates to rides and, more specifically, to an amusement ride system and method.

Existing interactive amusement rides use lasers, lights or other devices that are operated by guests to shoot at targets, which have a minimal cause-and-effect relationship to the reaction of the targets. Other rides may use water guns leaving the riders wet after the experience or may not be operated during colder seasons.

As can be seen, there is a need for an amusement ride system design providing interactive play shooting from a moving ride vehicle to interactive targets or other player/ride vehicles.

SUMMARY OF THE INVENTION

In one aspect of the present invention, a ride system utilizing a vehicle, a user riding the vehicle, and a projectile includes: a shooting device adapted to shoot the projectile; an aiming facility operable by the user to aim the shooting device; and a triggering device operable by the user to fire the shooting device; wherein the user rides the vehicle, aims the shooting device, and fires the device to shoot the projectile.

In another aspect of the present invention, a ride system includes: a ride vehicle; a plurality of projectiles; and a projectile launching device, aimed and activated from within the ride vehicle, to propel the projectiles.

In yet another aspect of the present invention, a method for a ride includes: providing a shooting device; providing a plurality of projectiles; and aiming and shooting the projectiles utilizing the shooting device.

DETAILED DESCRIPTION

Figure 1:
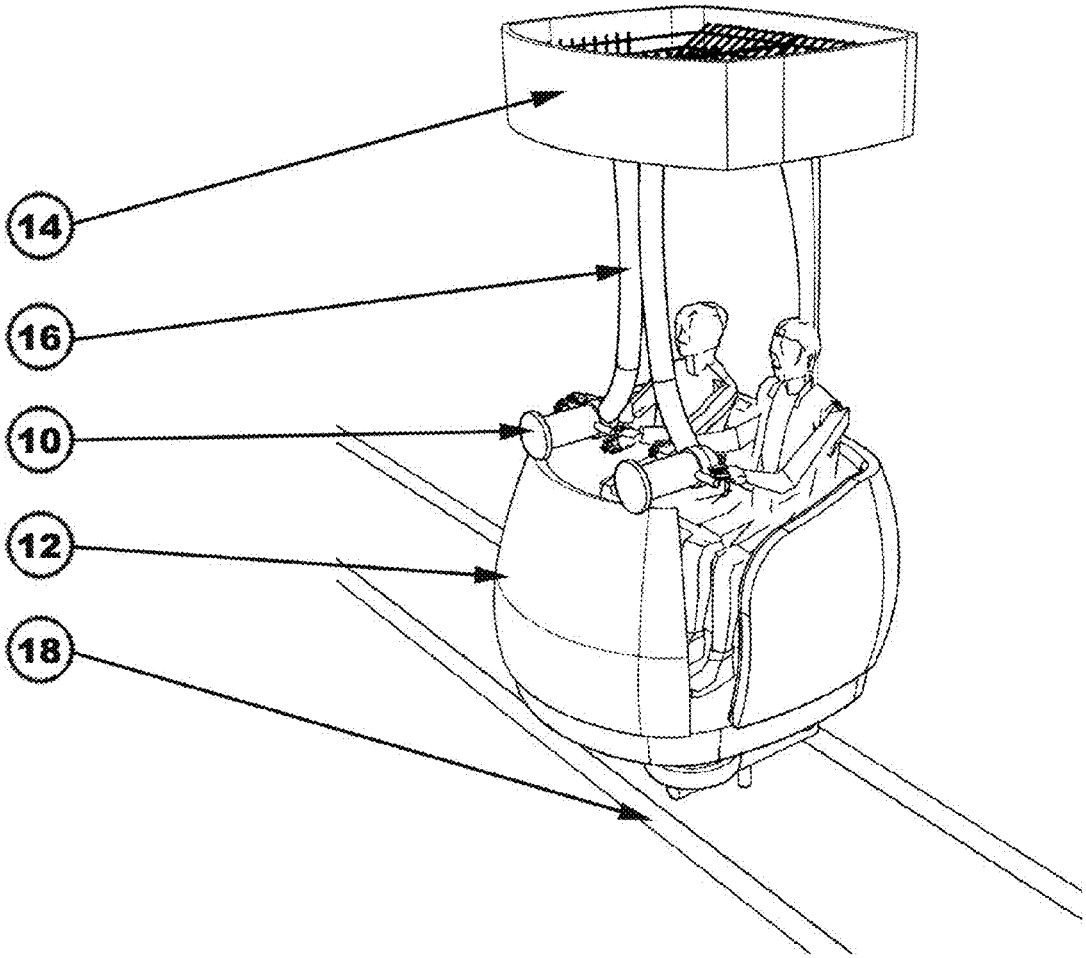
FIG. 1 depicts an embodiment of the present invention.

The preferred embodiment and other embodiments, including the best mode of carrying out the invention, are hereby described in detail with reference to the drawings. Further embodiments, features and advantages will become apparent from the ensuing description or may be learned without undue experimentation. The figures are not drawn to scale, except where otherwise indicated. The following description of embodiments, even if phrased in terms of "the invention," is not to be taken in a limiting sense, but describes the manner and process of making and using the invention. The coverage of this patent will be described in the claims. The order in which steps are listed in the claims does not indicate that the steps must be performed in that order.

Broadly, an embodiment of the present invention generally is an amusement ride system designed to provide interactive play shooting from a moving ride vehicle to interactive targets or other player/ride vehicles.

In an embodiment of the present invention, which could be called the "BLAMMO" system, the device uses guest operated shooting devices that propel or launch impact safe dry media allowing the guests to see know if their shots are hitting the targets, and creating a kinetic and dynamic ride environment.

Embodiments of the present invention provide shooting, launching, propelling, or projectile capabilities within the ride vehicle to interactive, fixed, or moving targeting systems using impact-safe projectiles. The system also includes automated conveyers to collect, re-circulating, and transport impact-free projectiles, and to reload each ride vehicle. Interactive targeting systems also re-set, shoot back, or activate other devises within the show, setting elements, or ride vehicle track.

An embodiment of this device may include the following components or aspects:

- A ride system;
- Guest operated projectile shooting/launching/propelling devices;
- Soft, Impact-safe projectiles;
- Projectile collection, gathering;
- Conveyors/transporters to deliver the projectiles from the target areas to where they can be loaded onto the ride vehicles;
- Loading of projectiles onto vehicles, as part of the show;
- Targets, themed or un-themed;
- Targets that respond to impact, and reset;
- Targets in groups that reset after all the targets in the group have been hit; and
- Target areas that are sloped to allow for the projectiles to drain to a collection area.

In an embodiment, the aiming facility might be handles for the user's hands to rotate the shooting device. The triggering device might be a trigger or button, possibly on or near the handle for the user's hands, or any other activator. Another embodiment includes the vehicles, tracks, targets and/or return system in a package. An embodiment may be an add-on, by adding a media launching device, consisting of a shooting device with an aiming facility and a triggering device, to an existing ride vehicle. Embodiments are methods for rides, or for adding-on to rides.

An embodiment of the system may have dry media launchers or gun mechanisms incorporated into amusement ride vehicles. These guns may be operated by guests who will activate a triggering device to propel the dry media, which may be called projectiles. The media may be propelled by using a compressed air system, an electrically operated launcher or by other means. The ride environment may include targets that react when impacted by the dry media. The dry media may be impact safe, and possible targets may include other ride vehicles and other guests. Embodiments of rides may consist of numerous scenes or target areas.

In an alternate embodiment of the invention, each of the target areas may be configured to have the media drain to a collection area, where a conveyor or collection device re-circulates the media to an area where the media can be loaded onto vehicles.

An embodiment of the invention can be incorporated into existing or new ride systems by others. The targets and target areas are designed to channel the dry media to a local collection point. A conveyor or transporter system may return dry media to a central collection point, where it is loaded onto the ride vehicles.

An embodiment of the invention can be incorporated into several different types of existing or new amusement ride systems, and adapted to any intellectual property or theme. A ride layout may be created based on the ride system, theme, desired capacity and other requirements of a specific client. A building may be designed to incorporate the rides system, the scenes and all the specified components, including the target areas and the media collection system. The ride vehicles may be designed and modified to accept the "BLAMMO" shooting devices, and scenes may be designed with the interactive targets.

As depicted in FIG. 1, an embodiment of the present invention may include media launching devices 10, ride vehicles 12, a media repository 14, feeder tubes 16, ride tracks 18, targets 20, and a return system 22.

As to media launching devices 10, guests can aim launching devices and propel the media by activating a triggering device. The aiming facility for the users to fire the triggering device can be handles or another mechanism to indicate or control where to shoot the projectile.

As to ride vehicle 12, embodiments can be adapted to work with any existing or new type of ride system by others, including hanging rides, trackless dies, omni-mover type rides, boat rides, or any other ride system. Embodiments can work with any number of guests per vehicle and any seating configuration.

As to media repository 14, impact safe media are carried on board ride vehicles in bins. The media can be loaded onto vehicles any time during the ride sequence, including prior to guest loading, while guests are loading or after guests have been loaded. Media can also be recharged one or more times during a ride sequence.

As to feeder tubes 16, media are fed from repository to launching devices via tubes, channels, tracks or other means.

As to ride tracks 18, embodiments may work with any new or existing ride system that uses any type of track system, including surface mounted tracks, overhead tracks, wire guided or any other trackless based system.

Figure 2:
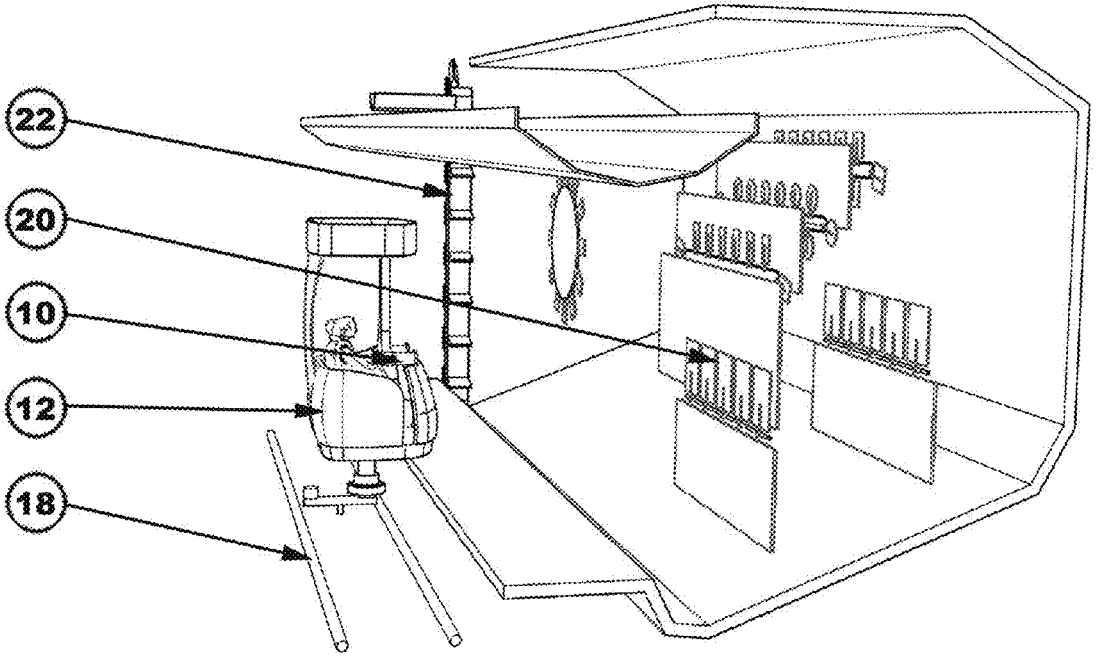
FIG. 2 depicts an embodiment of the present invention in use.

As depicted in FIG. 2, an embodiment of the present invention may include the media launching devices 10, vehicles 12, tracks 18, targets 20 and/or return system 22 in a package.

As to targets 20, targets are to respond to the impact of the impact safe media. Targets can be of any shape or size and can be alone or in groups, and each scene can have any variety of groups and types of targets. The targets could be un-themed and generic in nature or be designed to be part of a specific or non-specific intellectual property.

As to return system 22, the impact safe media is collected from the scene areas and returned to a central location where it can be loaded onto vehicles.

The embodiment of FIG. 2 shows a sloped set area that allows the media to drain to a machine that conveys it to an overhead trough that uses gravity to transport the media to the central collection area. Embodiments can utilize any number of methods of collection and recirculation of the media, including conveyors, vacuums, sloped surfaces or other means. The collection of media could be hidden from guests or be exposed to the guests and be part of the show experience.

An embodiment of the invention could be used by theme parks, location based entertainment venues or any place people gather for amusement or entertainment.

It should be understood, of course, that the foregoing relates to exemplary embodiments of the invention and that modifications may be made without departing from the spirit and scope of the invention as set forth in the following claims.

We claim:

1. A ride system utilizing a vehicle, a user riding the vehicle, and a projectile, the ride system comprising:

a shooting device adapted to shoot the projectile;

a feeder mechanism to feed the projectile to the shooting device;

an aiming facility operable by the user to aim the shooting device;

a triggering device operable by the user to fire the shooting device; and a repository, outside of the vehicle, to store a plurality of projectiles, wherein the feeder mechanism feeds each of said projectiles from the repository to the shooting device, the user rides the vehicle, aims the shooting device, and fires the device to shoot the projectile.

2. A ride system utilizing a vehicle, a user riding the vehicle, and a projectile, the ride system comprising:

a projectile repository located above the vehicle;

a shooting device adapted to shoot the projectile;

a feeder mechanism to feed the projectile to the shooting device;

an aiming facility operable by the user to aim the shooting device; and a triggering device operable by the user to fire the shooting device;

wherein the user rides the vehicle, aims the shooting device, and fires the device to shoot the projectile.

3. A ride system utilizing a vehicle, a user riding the vehicle, and a projectile, the ride system comprising:

a shooting device adapted to shoot the projectile;

a tube from a projectile repository to the shooting device to feed the projectile to the shooting device;

an aiming facility operable by the user to aim the shooting device; and a triggering device operable by the user to fire the shooting device;

wherein the user rides the vehicle, aims the shooting device, and fires the device to shoot the projectile.

4. A ride system utilizing a vehicle, a user riding the vehicle, and a projectile, the ride system comprising:

a shooting device adapted to shoot the projectile;

a feeder mechanism to feed the projectile to the shooting device;

an aiming facility operable by the user to aim the shooting device;

a triggering device operable by the user to fire the shooting device; and a collection mechanism to collect the projectile after the device shoots the projectile and deliver the projectile to the ride system;

wherein the user rides the vehicle, aims the shooting device, fires the device to shoot the projectile, and the collection mechanism utilizes gravity to retrieve the projectiles.

5. A ride system utilizing a vehicle, a user riding the vehicle, and a projectile, the ride system comprising:

a shooting device adapted to shoot the projectile;

a feeder mechanism to feed the projectile to the shooting device;

an aiming facility operable by the user to aim the shooting device;

a triggering device operable by the user to fire the shooting device; and a collection mechanism to collect the projectile after the device shoots the projectile and deliver the projectile to the ride system;

wherein the user rides the vehicle, aims the shooting device, fires the device to shoot the projectile, and the projectiles are collected utilizing a sloped surface.

6. A ride system utilizing a vehicle, a user riding the vehicle, and a projectile, the ride system comprising:

a shooting device adapted to shoot the projectile;

a feeder mechanism to feed the projectile to the shooting device;

an aiming facility operable by the user to aim the shooting device;

a triggering device operable by the user to fire the shooting device; and a collection mechanism to collect the projectile after the device shoots the projectile and deliver the projectile to the ride system;

wherein the user rides the vehicle, aims the shooting device, fires the device to shoot the projectile, and the projectiles are collected, re-circulated, and transported to the shooting device utilizing conveyors.

7. A ride system utilizing a vehicle, a user riding the vehicle, and a projectile, the ride system comprising:

a shooting device adapted to shoot the projectile;

a feeder mechanism to feed the projectile to the shooting device;

an aiming facility operable by the user to aim the shooting device;

a triggering device operable by the user to fire the shooting device; and a collection mechanism to collect the projectile after the device shoots the projectile and deliver the projectile to the ride system;

wherein the user rides the vehicle, aims the shooting device, fires the device to shoot the projectile, and the projectiles are collected, re-circulated, and transported to the shooting device utilizing a vacuum.

* * * * *